US010801224B1

(12) United States Patent
Sorrentino

(10) Patent No.: US 10,801,224 B1
(45) Date of Patent: Oct. 13, 2020

(54) HOTEL WITH A GOLFING FACILITY AND METHODS OF OPERATING THE SAME

(71) Applicant: Claudio Vincenzo Sorrentino, Boca Raton, FL (US)

(72) Inventor: Claudio Vincenzo Sorrentino, Boca Raton, FL (US)

( * ) Notice: Subject to any disclaimer, the term of this patent is extended or adjusted under 35 U.S.C. 154(b) by 0 days.

(21) Appl. No.: 16/874,535

(22) Filed: May 14, 2020

Related U.S. Application Data

(60) Provisional application No. 63/022,946, filed on May 11, 2020.

(51) Int. Cl.
*E04H 3/02* (2006.01)
*A63B 69/36* (2006.01)

(52) U.S. Cl.
CPC ..... *E04H 3/02* (2013.01); *A63B 69/3694* (2013.01)

(58) Field of Classification Search
CPC ..... E04H 3/02; A63B 69/3694
See application file for complete search history.

(56) References Cited

U.S. PATENT DOCUMENTS 3,708,173 A 1/1973 Hewson
5,031,916 A * 7/1991 Boswell ..... A63B 69/3652 473/158
5,163,677 A 11/1992 Foley
5,395,115 A 3/1995 Ferns et al.
6,368,229 B1 * 4/2002 Wetherell ..... A63B 47/002 473/134
6,832,452 B1 * 12/2004 Simens ..... E04H 3/14 472/92
7,036,449 B2 * 5/2006 Sutter ..... B63B 35/44 114/264
7,513,841 B2 4/2009 Clifford
8,621,787 B2 * 1/2014 Barry ..... E04B 1/34869 52/220.1
9,016,000 B2 * 4/2015 Elliott ..... E04H 3/02 52/177
9,057,160 B2 * 6/2015 Scott ..... E01C 1/002
9,771,731 B2 * 9/2017 Canavati ..... E04H 3/02
2002/0072426 A1 * 6/2002 Reverchon ..... A63B 69/3694 473/168
2003/0226323 A1 * 12/2003 Travez ..... E04F 17/08 52/220.7

(Continued)

FOREIGN PATENT DOCUMENTS

CA 2420344 A1 8/2004
WO WO-9801190 A1 * 1/1998 ..... A63B 69/3694
WO WO-2019204774 A1 * 10/2019 ..... E04H 1/02

OTHER PUBLICATIONS (No author), webpage printout from https://www.oncoregolf.com/blogs/articles/oncore-buffalo-announce, "'-First-of-its-Kind' Golf & Sports Entertainment Complex Coming to Western New York," (Aug. 20, 2019) (3 pages).

(Continued)

*Primary Examiner* — Rodney Mintz
(74) *Attorney, Agent, or Firm* — Nelson Mullins Riley & Scarborough LLP

(57) ABSTRACT

The present teachings generally relate to accommodations (e.g., a hotel or other lodgings) providing access to a golf driving range from a guest's private room. Methods of entertainment for guests of a hotel comprising multiple guest units is also provided.

27 Claims, 5 Drawing Sheets

(56) References Cited

U.S. PATENT DOCUMENTS

| | | | | |
|---|---|---|---|---|
| 2005/0150175 | A1* | 7/2005 | Guigan | E04H 3/02 52/36.1 |
| 2005/0274312 | A1* | 12/2005 | Sutter | B63B 35/44 114/264 |
| 2006/0121996 | A1* | 6/2006 | Clifford | A63B 71/0669 472/92 |
| 2007/0000185 | A1* | 1/2007 | DeLine | E04H 3/04 52/33 |
| 2007/0074471 | A1* | 4/2007 | Gallagher | E04H 3/02 52/236.3 |
| 2007/0125109 | A1* | 6/2007 | Morasch | F24F 5/0046 62/235.1 |
| 2007/0184910 | A1* | 8/2007 | Aronchick | A63B 69/3694 473/169 |
| 2008/0127574 | A1* | 6/2008 | Yi | E04H 3/02 52/8 |
| 2012/0115622 | A1* | 5/2012 | Dowdy | A63B 69/3655 473/140 |
| 2013/0219816 | A1* | 8/2013 | Elliott | E04H 3/02 52/234 |
| 2015/0308136 | A1* | 10/2015 | Kuechenmeister | E04H 3/02 52/234 |
| 2017/0175409 | A1* | 6/2017 | Canavati | E04H 4/00 |

OTHER PUBLICATIONS (No author), webpage printout from https://www.ocwd.com/media/4279/prop05topgolf-overview-presentation.pdf, TopGolf (2016) (35 pages).

(No author), webpage printout from http://rangesystems.com/tag/drivingrange/page/18/ , Range Automation Systems (2020) (9 pages).

(No author), webpage printout from http://ir.driveshack.com/Cache/IRCache/a1b2ee64-5797-45c5-953a-7aed241fbd80.PDF?O=PDF&T=&Y=&D=&FID=a1b2ee64-5797-45c5-953a-7aed241fbd80&iid=4040318, Newcastle Investor Presentation (Dec. 2016) (18 pages).

(No author), webpage printout from https://www.golfpunkhq.com/news/article/troon-golf-to-manage-4ore-golf,golfpunkhq (Nov. 2, 2016) (3 pages).

Kilbridge, D., webpage printout from https://golfweek.usatoday.com/2017/11/09/video-charl-schwartzel-hits-golf-ball-out-of-hotel-balcony/, (Nov. 9, 2017) (4 pages).

(No author), webpage printout from https://medium.com/@Malibu_Tech/6-simple-ways-to-re-vamp-your-balcony-space-d495c77457c3, (Mar. 3, 2016) (5 pages).

* cited by examiner

HOTEL WITH A GOLFING FACILITY AND METHODS OF OPERATING THE SAME

RELATED APPLICATION

The present application claims priority to U.S. provisional application No. 63/022,946, filed on May 11, 2020 and entitled "Hotel With a Golfing Facility and Methods of Operating the Same," the teachings of which are incorporated herein in their entirety.

FIELD

The present teachings generally relate to hotel accommodations providing access to a golf driving range from a guest's private balcony, for amusement and/or serious practice.

BACKGROUND

A hotel's amenities may be a big draw for potential guests selecting between various accommodations. For example, a golf resort provides its guests with lodging as well as access to the property's various golfing facilities such as one or more golf courses, practice areas (e.g., driving range, putting green), and a clubhouse associated with the property. While golf resorts may also include amenities for guests while not golfing (or that do not golf) such as restaurants, pools, and shops, many guests at a golf resort may prefer to spend the bulk of their stay working on their swing. Indeed, one or more daily rounds at the resort's various courses may not even satisfy the most diehard golfers.

It is therefore an object of the present teachings to enable multi-unit accommodations (whether as part of a golf resort or otherwise) to provide its guests with convenient, nearly-continuous access to golf practice facilities.

SUMMARY

Embodiments of the present invention generally relate to accommodations (e.g., a hotel or other lodgings) providing access to a golf driving range from a guest's private room. While such teachings may be particularly applicable to lodgings at a golf resort where golfers tend to congregate, it will be appreciated that the present teachings may provide any lodging facility with additional amenities that can help attract professional golfers, low-handicappers, weekend hackers, and even non-golfers to the property. Indeed, the present teachings allow guests to practice golf from their own private rooms, thereby potentially increasing the time guests are on-property and spending money on additional services (e.g., room service). In various embodiments, a method of entertainment for guests of a hotel comprising multiple guest units is provided. For example, in some embodiments, the method may comprise providing a hitting area to each of a plurality of guest units of a hotel. Each hitting area may be disposed within an open air location associated with one of the guest units and only accessible to a user through the corresponding guest unit. Each guest unit may be provided with at least one bed and a bathroom and may be separated from a common area by a door that can be secured by the one or more guests associated with that guest unit. A target area (e.g., a driving range) comprising one or more targets for a golf ball hit from the hitting area associated with each of the plurality of guest units may also be provided. Additionally, a barrier may be provided to each of the plurality of guest units, wherein the barrier is configured to separate the open air location associated with each of the guest units from a room in the corresponding unit. In some aspects, a golf mat may be provided within each hitting area of the plurality of guest units and/or each hitting area may comprise a balcony.

The barrier between the open air location and the room in the guest unit can have a variety of configurations. For example, in some aspects, the barrier may comprise a door. Additionally, at least a portion of the barrier may be transparent. By way of non-limiting example, the barrier may be a wall having a door and windows and/or may be a sliding glass door. In various aspects, the barrier can also comprise various features so as to isolate the guest room from the open air location such that a user on the unit's hitting area or other adjacent hitting areas do not interfere with a guest that is sleeping, for example. In some example aspects, the barrier may be configured to dampen transmission of sound between the open air location and the room. By way of example, the barrier may comprise a double-paned glass door. In some aspects, the barrier may exhibit a composite sound transmission class (STC) greater than about 50 (e.g., greater than about 60) in order to substantially reduce or eliminate noise from activities on the open air location (e.g., talking, golf ball contact) from being transmitted into the guest room when the barrier is closed. In some aspects, methods in accordance with the present teachings can comprise lighting the target area and/or the hitting area, and providing a retractable shade to the barrier between the hitting area and the room in the guest unit to selectively prevent light being transmitted into the room if desired.

In addition, one or more additional barriers can be provided to the guest units in accordance with various aspects of the present teachings. For example, a protective barrier can be provided to each of the plurality of units in the open air location to prevent access to the hitting area and/or to prevent a guest from falling from the hitting area when not in use. By way of example, the protective barrier (e.g., a gate) may be disposed between the hitting area and the barrier that separates the open air location from the room in the guest unit. In some related aspects, a sitting area can be provided in the open air location between the protective barrier and the barrier to the room in the guest unit. Additionally or alternatively, a protective barrier may be provided to at least partially separate the hitting area from the target area. In some such aspects, the protective barrier may be retractable, for example, when a user is ready to hit from the hitting area so as to not impede the travel of the golf ball. Additionally, methods in accordance with the present teachings may comprise retracting the protective barrier prior to the user being able to hit a golf ball from the hitting area to the target area. By way of non-limiting example, a ball delivery mechanism for delivering a golf ball to be hit may not present a golf ball to the user until the retractable protective barrier is opened. In accordance with various aspects of the present teachings, the open air location for each of the plurality of units may be separated from the open air location of at least one of the other of the plurality of the units by a fixed barrier. In such aspects, users may not be able to access the open air location of adjacent guest units.

As noted above, each guest room may be separated from a common area accessible to other guests by a door that can be secured by the one or more guests associated with that guest unit. The door may be accessed via a security card or key, for example, and can allow the guest to lock the door upon leaving the room and entering the common area. By way of non-limiting example, the common area may comprise an interior hallway or an exterior corridor.

The target area may enable ratings to be provided to individual shots and/or practice sessions (or portions thereof), as well as games or competitions. By way of example, golf ball tracking technologies (e.g., TRACKMAN) could provide details regarding ball flight and/or the user's swing or club face. Additionally or alternatively, "smart" balls may be provided to the users such that the final location of each shot may be determined, for example, to determine whether a shot to an intended target was successful. In some aspects, for example, methods can comprise receiving coordinates for one or more first golf balls hit from a first hitting area associated with a first unit. Additionally, a display can be provided to the open air location of each unit such that a first score indicative of the proximity of the one or more first golf balls relative to at least one of the one or more targets can be displayed to the user.

In addition to a user or users of a particular room being able to practice or play games, methods in accordance with the present teachings may also enable users of hitting areas associated with a plurality of guest units to play games and/or compete against one another. For example, coordinates for one or more second golf balls hit from a second hitting area associated with a second unit can be received such that a second score indicative of the proximity of the one or more second golf balls relative to at least one of the one or more targets may also be displayed on the display associated with the first unit.

As noted above, each hitting area may also be associated with a ball delivery mechanism for delivering golf balls thereto. By way of non-limiting example, golf balls can be delivered manually (e.g., via room service) or automatically to the hitting area (e.g., via gravity-fed or pneumatic delivery).

In various embodiments, an accommodations and entertainment complex is provided comprising a hotel having a plurality of guest units, wherein each of the plurality of guest units is separated from a common area by at least one door that is configured to be secured by the one or more guests associated with that guest unit. Each guest unit includes one or more beds, a bathroom, and a hitting area within an open air location (e.g., a balcony), wherein the hitting area is only accessible through the corresponding guest unit. A barrier is configured to separate the open air location from at least one room associated with the guest unit. Additionally, the complex may comprise a target area having one or more targets for a golf ball hit by a user from the hitting area associated with each of the plurality of guest units. A golf mat may be disposed within each hitting area of the plurality of units.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DETAILED DESCRIPTION

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly it will be apparent that the described embodiments may be susceptible to alteration or variation according to common general knowledge without departing from the scope of the disclosure. The following detailed description of embodiments is not to be regarded as limiting the scope of the applicant's teachings in any manner.

While traditional hotels generally require guests to leave their private quarters to access the property's various outdoor amenities, the present teachings provide guests the opportunity to access outdoor entertainment (or serious golf practice) from their private hotel rooms without having to traverse the hotel's common areas. Indeed, rather than venturing off-property, lodgings in accordance with the present teachings can provide additional marketing opportunities and/or revenue streams by increasing the time guests utilize additional services offered by the property (e.g., room service for food, beverages, and range balls) while remaining in the comfort of their private rooms. Though the discussion herein generally describes an example accommodations and entertainment complex as a hotel having a plurality of private guest units with access to a golf driving range, it will be appreciated by the person skilled in the art that any short- or long-term lodging having a plurality of private living units (e.g., having one or more beds and bathrooms) may be configured to access a driving range in accordance with the present teachings. Example structures suitable for use in accordance with the present teachings include hotels, motels, apartment buildings, condominiums, and bungalows, as well as mixed use dwellings (e.g., a building containing both hotel rooms and condo units).

Figure 1:
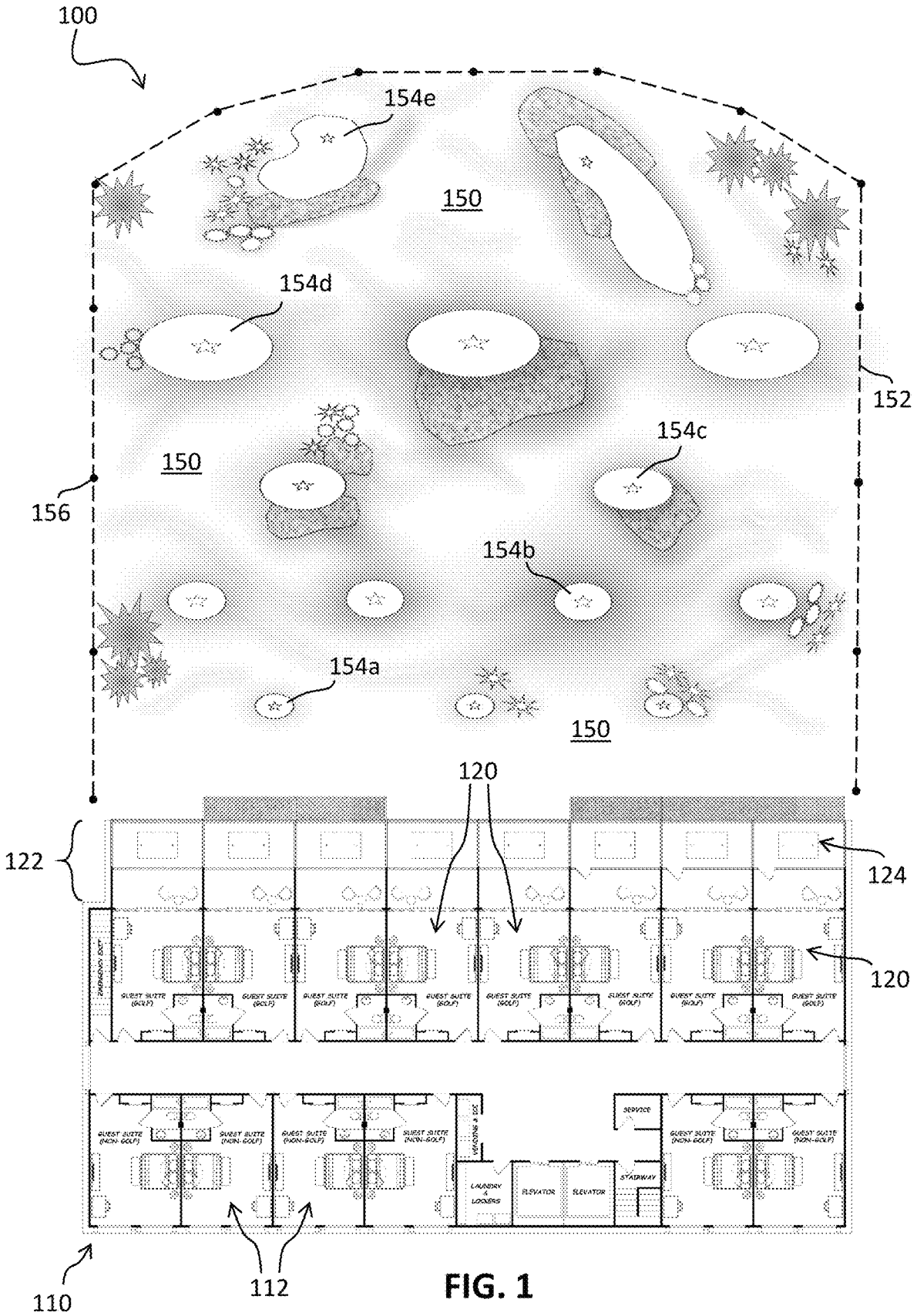
FIG. 1 depicts an exemplary accommodations and entertainment complex in accordance with various aspects of the present teachings.

FIG. 1 depicts an example accommodations and entertainment complex 100 in accordance with various aspects of the present teachings. As shown, the complex 100 generally comprises a hotel building 110 having a plurality of guest units 120 (e.g., suites, hotel rooms) that are adjacent to and face a target area 150. For the plurality of guest units 120 facing the target area 150 shown in FIG. 1, each may be provided access to the target area 150 from an open air location 122 associated with the guest unit so as to enable a user to hit a ball from their guest unit 120 into the target area. In particular, the open air location 122 associated with each of the units 120 may include a hitting area 124 as discussed in detail below that is only accessible to a user through the corresponding unit 120. However, as not all guests may be interested in having direct access to golf practice facilities, the hotel building 110 may also include a plurality of guest units 112 without access to the target area 150. It will be appreciated that though such units 112 are shown as being disposed on the opposite side of the building 110 from the target area 150 and do not include an open air location associated therewith (e.g., a balcony), these standard units 112 could also have an open air location and/or face the target area 150 but without an area from which to hit golf balls.

As shown in FIG. 1, the target area 150 abuts the hotel building 110 on one side and is generally bounded on the other sides by netting 152 so as to generally contain golf balls hit from the guest units 122, to prevent unauthorized access to the target area 150, and/or to prevent injury to passersby. The target area 150 can have a variety of dimensions, but in some aspects, has a length of at least 250 yards (e.g., at least 300 yards, at least 350 yards) as measured from the hitting areas 124 to the uppermost netting 152 in FIG. 1. Similarly, the target area 150 can have a variety of widths, but is generally at least as wide as the plurality of guest units 120 having hitting access to the target area 150. In some aspects, it may be preferable to widen the target area to accommodate guests tending to hook or slice their shots.

With continued reference to FIG. 1, the example target area 150 includes a plurality of targets 154*a-d* that are disposed throughout the target area. The targets 154*a-e* can have various sizes, shapes, and configurations so as to provide a user the ability to practice a variety of shots and/or clubs. As shown, the example targets 154*a-e* may be disposed at various distances from the hitting areas 124, with targets 154*a-d* of increasing distance having an area that is generally proportional to the distance from the hitting areas 124 to promote the user being more accurate for shots of shorter distance. For example, target 154*d* may be disposed about 175 yards from hitting areas 124 and may have a larger "scoring" area than target 154*a*, which may be disposed about 60 yards from hitting areas 124. As noted above, the targets 154*a-e* may have a variety of shapes or configurations and comprise natural or artificial materials. For example, target 154*e* may replicate an actual green with real grass as well as a hole and pin, while target 154*b* may be a circular target having concentric nettings or bins to assess a user's proximity to the center of target 154*b* by tracking each ball hit, as is known in the art. In addition to the targets themselves, the target area 150 can include one or more additional features that are commonly faced on a golf course or driving range such as a water hazard, sand traps, slopes, and/or vegetation.

In some aspects, the target area 150 can also be illuminated so as to enable guests to practice before sunrise and/or after sunset. For example, as shown in FIG. 1, the target area 150 may include a plurality of lights 156 positioned along the netting 152 to illuminate the entire target area 150 or particular portions thereof (e.g., targets 154). As discussed below, the guest rooms 120 facing the target area 150 may include shades (e.g., blackout curtains) on the barrier to the open air location 122 different than those provided to guest rooms 121 so as to better prevent transmission of light into the guest room due to the potentially high brightness provided by the lights 156 of the target area and/or the more active use of their open air location 122.

It will be appreciated that various features shown in FIG. 1 are examples only, and that the accommodations and entertainment complex 100 may additionally include other buildings and amenities such as one or more golf courses, a clubhouse, a pro shop, pools, restaurants, and shopping. In addition, though the depicted hotel floorplan of FIG. 1 primarily comprises guest suites, one or more of guest units 122 could instead be a dedicated pro shop and/or practice facility such that users could try out new clubs and/or obtain lessons from a pro. Moreover, it will be appreciated in light of the present teachings that the complex 100, hotel building 110, and/or target area 150 can be configured to not only provide private access to guests of units 120, but also to various other users/guests from one or more locations abutting the target area 150. By way of example, one floor of the hotel building 110 (e.g., the ground floor) may provide access to a driving range from a common area. Moreover, one or more separate hitting areas could be provided to the left or right of the hotel building 110 of FIG. 1, with the netting 124 expanded in turn to allow those users to access the target area 150. Additionally or alternatively, in some embodiments, the netting 124 on the far side of the target area 150 (i.e., the top of FIG. 1) can instead be replaced with one or more additional hitting areas to also provide access to the target area 150. It will be appreciated that with sufficient distance between the guest units 120 and the hitting areas on the far side of the target area 150, there would be limited risk of golfers hitting each other. In some aspects, such hitting areas on the opposite side of the target area 150 (or portions thereof) can be associated with additional services and/or different targets, for example, to provide a driving range for various users such as professional golfers and/or those under the instruction of a golf pro.

Figure 2:
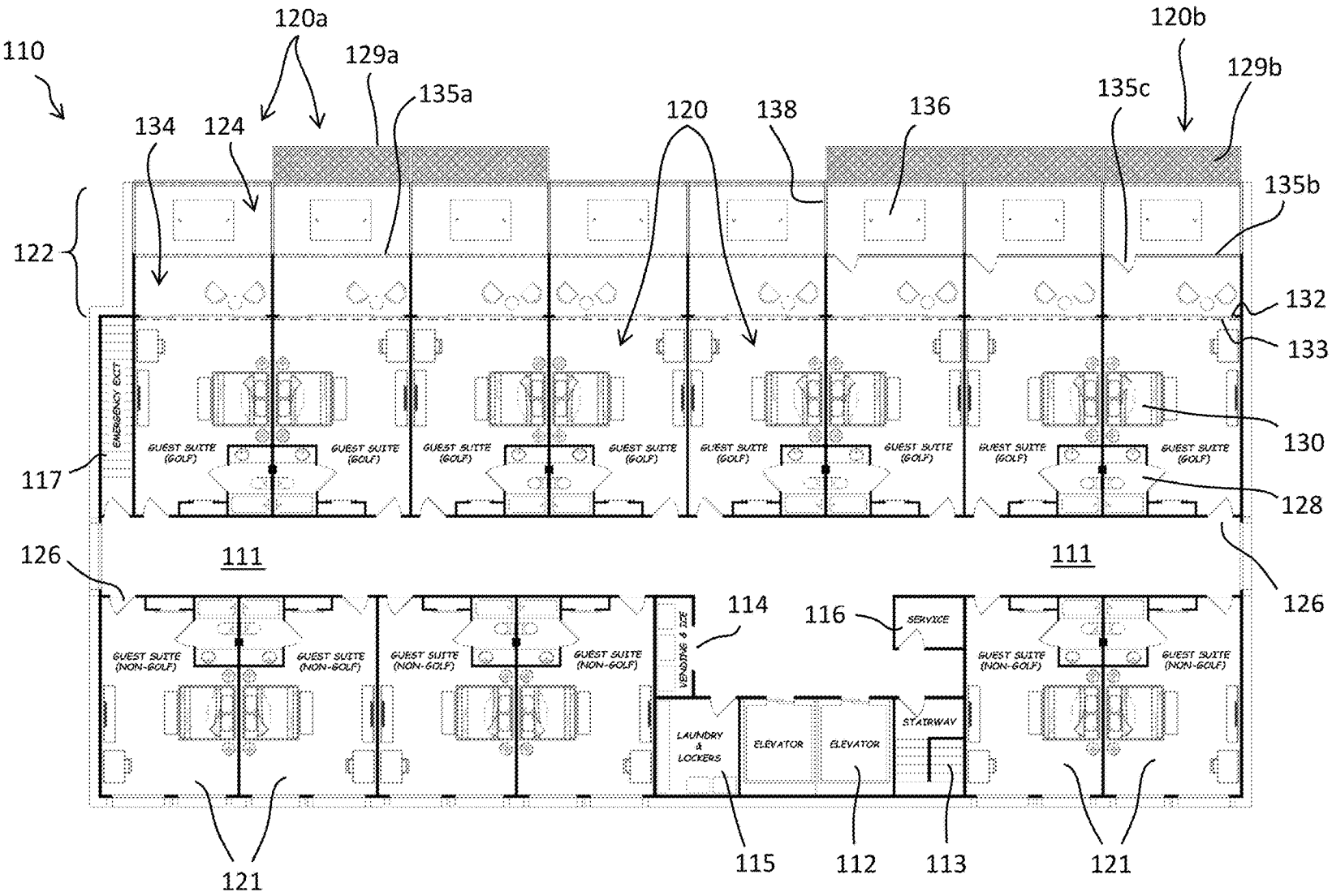
FIG. 2 depicts the example hotel of FIG. 1 in additional detail.

With reference now to FIG. 2, the example floorplan of the hotel 110 of FIG. 1 is shown in additional detail, with a plurality of golfing guest units 122 and standard (non-golfing) guest units 121 each separated from a common hallway 111 by a door 126. Though this example floorplan depicts an upper floor of a hotel with the lobby located below such that the guest units 122 are above ground level, it will be appreciated that the depicted guest units 122 could alternatively be located on the ground floor. In addition, it should be noted that multiple floors of the hotel 110 could include a similar floorplan such that golfing guest units 122 could be directly above and/or below a golfing guest unit on another floor. Moreover, it will be appreciated that though there are guest units disposed on each side of the common, interior hallway 111 shown in FIG. 2, a hotel layout may alternatively provide that the entryway to the guest units be accessed from outside the building 110, such as an exterior corridor.

As shown in FIG. 2, the hotel 110 includes two elevators 112 and a set of stairs 113 for guests to access the depicted floor from one or more other floors. Additionally, one or more additional stairwells 117 can be provided to allow guests to safely exit in the case of an emergency. The elevators 112 and stairs 113 open into a foyer, which is connected to the hallway 111 for accessing the guest units 121, 122. The foyer also includes a vending/ice area 114, laundry/locker room 115, and a service room 116 (e.g., only accessible to hotel staff). Unlike a conventional hotel's vending area, the vending/ice area 114 can, in some aspects, include a golf ball dispenser such that guests can obtain range balls without having to go down to the lobby. Additionally or alternatively, some aspects of the present teachings allow a guest to order range balls via room service or enable the automatic delivery directly to that guest's open air location, as discussed below. Adjacent the vending/ice area 114, the laundry/locker room 115 can be accessed by the guests and can contain one or more lockers (e.g., accessible by the guest's room card or key) that allow a user to secure golf clubs when not in use either at the course or at a guest unit's hitting area 124.

As noted above, one side of the depicted common, interior hallway 111 includes eight doors 126 for individually accessing the example golfing guest units 120, each of which includes an open air location 122 having a hitting area 124 from which golf balls can be hit at the target area of FIG. 1. As shown in FIG. 2, the door 126 into each guest unit 120 opens to an entryway from which a private bathroom 128 having a toilet and a shower and/or bathtub and the sleeping portion of the guest unit 120 having a bed 130 disposed therein can be accessed. Of course, the guest units 120 can include one or more additional furnishings common to a hotel room such as a TV, dresser, bedside tables, minibar, etc.

Figure 3A:
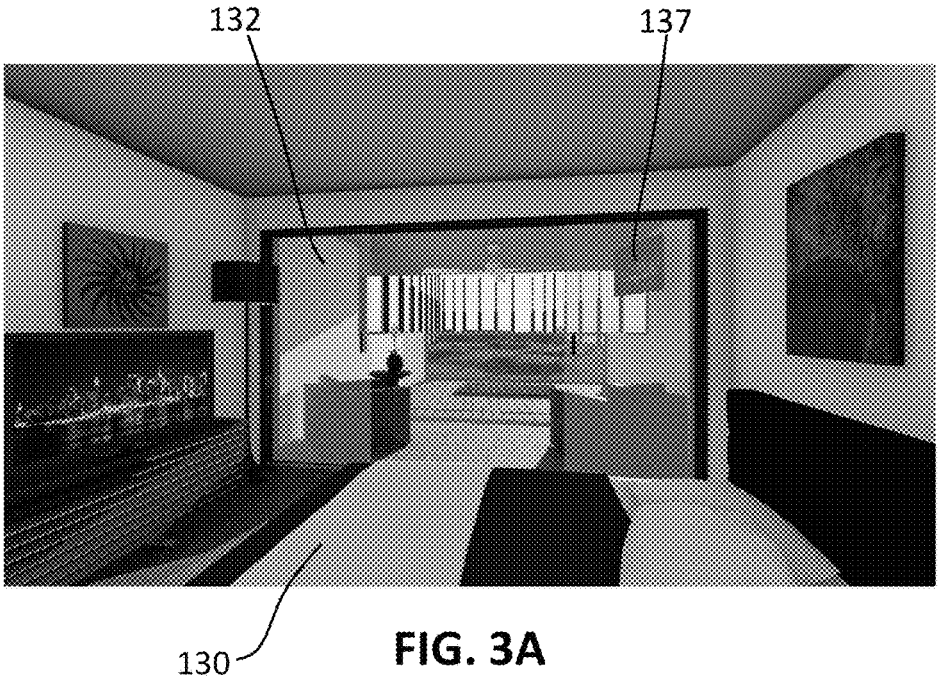
FIGS. 3A-B depict an example guest suite in accordance with various aspects of the present teachings.
Figure 3B:
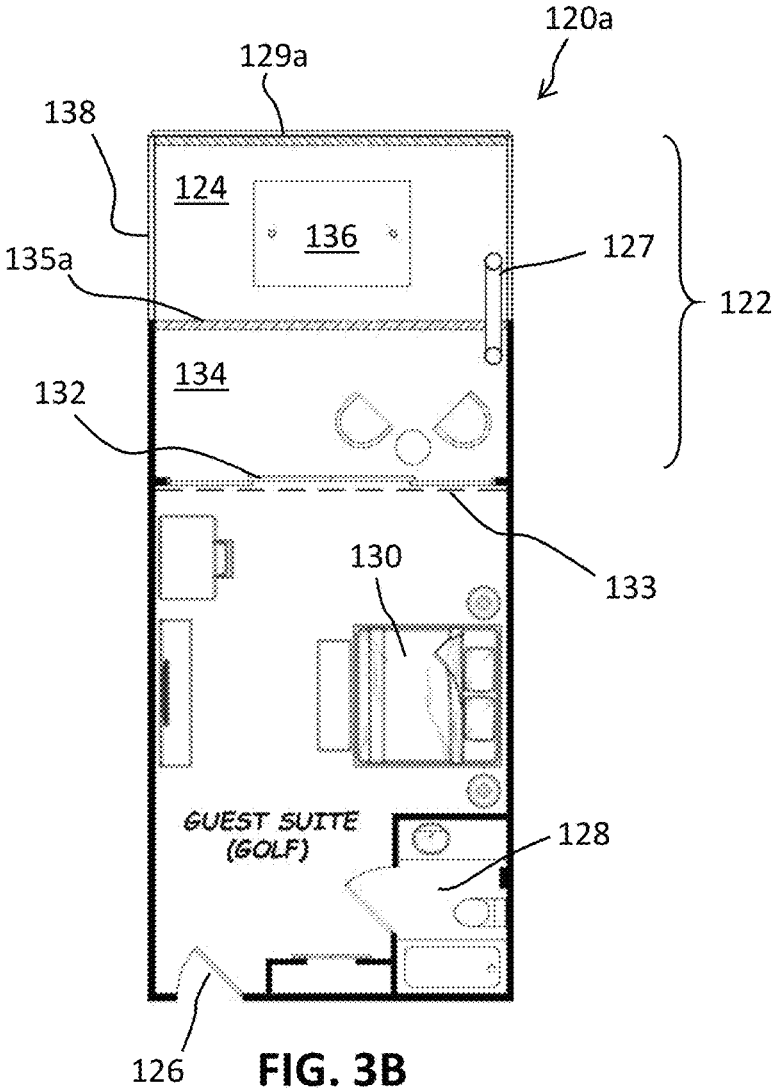
Figure 4A:
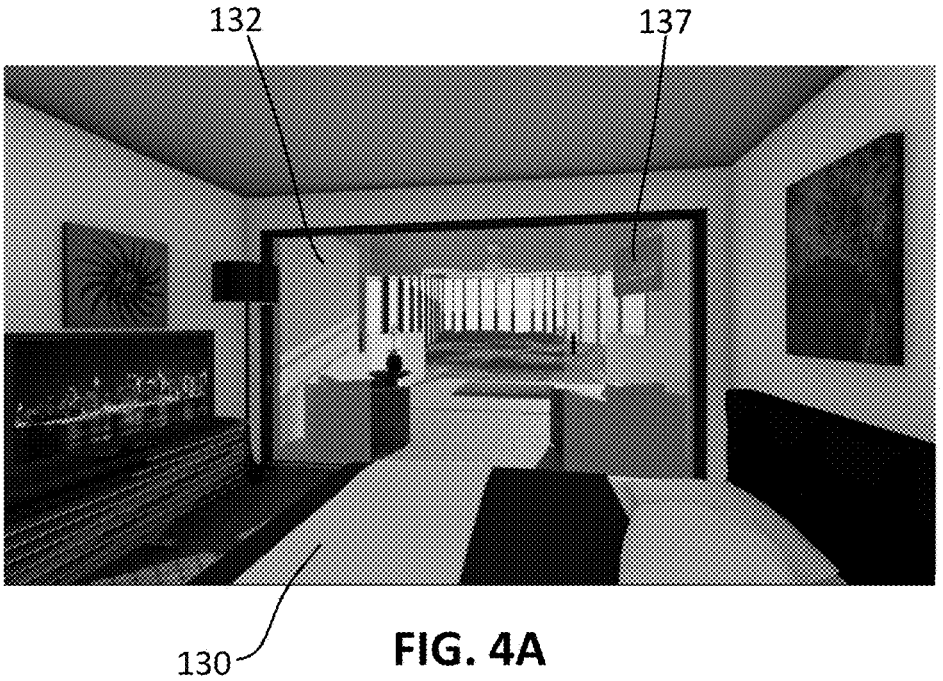
FIGS. 4A-B depict the example guest suite of FIGS. 3A-B with a protective barrier being retracted to enable balls to be hit from the hitting area in accordance with various aspects of the present teachings.

With reference now to FIGS. 2-4, the side of the sleeping portion of guest unit 120 opposite door 126 terminates in a barrier 132, which separates the interior of each guest unit 120 from its private open air location 122. As best shown in FIGS. 3A and 4A, the example barrier 132 substantially comprises a sliding glass door to allow a user to access the open air location 122. However, the barrier 132 is not so limited and may instead comprise a solid, non-transparent wall, for example, having a transparent or non-transparent, standard door and one or more transparent windows as long as the barrier 132 is generally sufficient to separate the exterior and interior portions of the building.

In various aspects, the barrier 132 can additionally be configured to minimize interference between exterior activities and the interior of the guest unit 120. For example, in accordance with the present teachings, it may be preferable to substantially block sound and/or light from being transmitted through the barrier 132 into the guest unit 120 from either the unit's own hitting area 124, from hitting areas of adjacent units, or from the target area 150 (e.g., light from lights 156). By way of non-limiting example, the barrier 132 may be configured to dampen transmission of sound between the open air location 122 and the interior room of the guest unit 120 when the barrier is closed. By way of example, the barrier 132 may comprise a double-or triple-paned glass door that may be effective to substantially attenuate the sound of guests conversing within the open air location 122 and/or the sound of the club contacting the golf ball. It will be appreciated that because some clubs produce a sharp sound upon impact, an additional sound barrier may be desired. Indeed, in some aspects, the barrier may exhibit a composite sound transmission class (STC) greater than about 50 (e.g., greater than about 60) in order to substantially reduce or eliminate noise from activities on the open air location. Notably, in some aspects, the expense associated with the reduced sound transmission need not be provided to every guest unit depending on their location relative to the target area 150 and/or hitting areas 124. By way of example, a standard guest unit 121 lacking a hitting area 124 may be provided with different or standard, less expensive barriers, windows (e.g., double-paned instead of triple paned-glass), and doors due to their distance from practicing golfers.

Figure 4B:
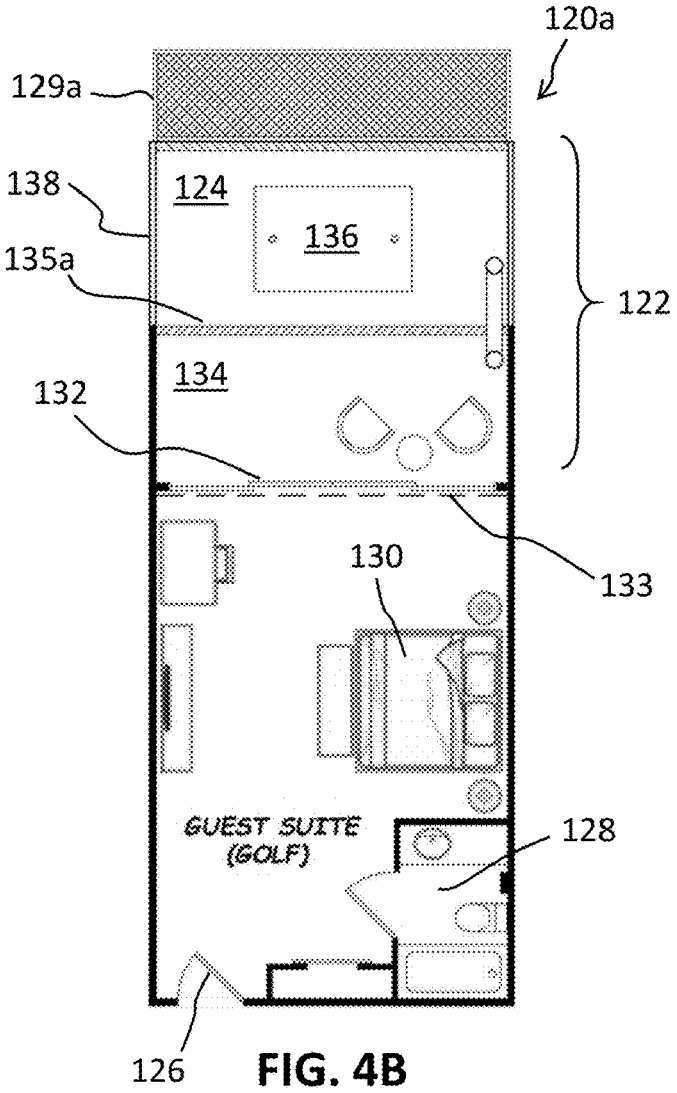

Additionally, because some golfers will want to practice early in the morning or late into the night, some aspects of the present teachings also provide selectively decreased light transmission from the open air location 122 into the guest room. Accordingly, as best shown in FIGS. 2, 3B, and 4B, the barrier 132 may be selectively covered by shades 133 (e.g., retractable blackout curtains) when a guest wishes to substantially prevent light to the guest rooms from the open air location 122 (e.g., a lighted hitting area 124 associated with that unit) and/or from the bright lights 156 of the illuminated target area. In such circumstances, a guest within the unit 120 would be unable to watch a golfer 120 hitting from the hitting area 124. As suggested above with respect to the ability of barrier 132 to block sound, guest rooms 120 having a hitting area 124 may include such shades having improved light-blocking properties, while guest rooms 121 may have standard and/or less expensive window treatments depending on their location relative to the lighted target area 150 or nearby hitting areas 124. For example, in some aspects, the window treatments 133 in guest rooms 120 may prevent more than 90% (e.g., more than 95%, more than 99%) of external light from being transmitted from the open air location into the guest room 120 in order to substantially reduce or eliminate light entering the room from the open air location 122 or target area 150. Notably, in some aspects, the expense associated with the reduced light transmission need not be provided to every guest unit depending on their location relative to the target area 150 and/or hitting areas 124. By way of example, a standard guest unit 121 lacking a hitting area 124 may be provided with different or standard, less expensive window treatments (e.g., preventing 50% of external light) as there could exist less illumination outside of these units 121 during nighttime hours.

While the entirety of the open air location 122 may allow a user to hit a golf ball toward target area 150, in some aspects, the open air location 122 may be separated into one or more areas in addition to the hitting area 124. By way of example, the depicted open air location 122 additionally comprises a sitting area 134, for example, having chairs as could a conventional hotel balcony or patio. Notably, in various aspects, the hitting area 124 and/or the open air location 122 of each unit is not accessible from the open air location 122 of adjacent units in that a fixed barrier such as a wall 138 separates the units and generally inhibits unauthorized access. As best shown in FIGS. 3A and 4A, the open air location 122 may comprise a display 137 visible by a user in the hitting area 124 and/or sitting area 134. As discussed below, the display 137 can provide statistics about a user's swings or shots and can enable games to be played among users of a single guest unit 120 or multiple guest units.

As shown in FIGS. 2-4, a golf mat 136, from which a user can hit balls such as those typically used at a driving range, may also be provided to the hitting area 124. Any known or hereafter golf mat modified in accordance with the present teachings can be used, but generally provides a surface from which to hit golf balls without damaging a user's clubs. For example, the golf mat 136 can comprise an artificial surface (e.g., fake grass, ASTROTURF) over a rubber or concrete layer. Additionally or alternatively, the golf mat 136 can comprise a stand of natural grass and/or an area of sand to replicate the hitting experience from an actual teebox, fairway, rough, or bunker. In addition, the golf mat 136 may include one or more rubber tees (e.g., which can extend from one or more pre-fabricated holes in the artificial turf) and/or be capable of securing a tee upon which a golf ball may be raised from the surface of the mat 136.

Multi-tiered (e.g., two story) driving ranges commonly have netting or other such safety measures to prevent a golfer on an upper level from falling to ground level, for example. Similarly, with reference to the particular guest unit 120*b* shown in FIG. 2 and FIG. 5, for example, a fixed safety structure (e.g., net 129*b*) may be provided between the hitting area 124 and target area 150 to prevent falls. However, in the context of the instant application, the present teachings provide further precautions as some guests with access to the hitting area 124 (e.g., a guest's small children) may wander into the hitting area 124 without adult supervision and/or without the express purpose of practicing on their game. For example, in various aspects, the barrier 132 between the open air location 122 and the interior of the guest unit 120*b* may not only be secured from the inside to prevent unauthorized access into the guest unit 120 (e.g., the barrier 132 may be locked from the inside as with a standard hotel), but also a user of the hitting area 124 may selectively lock the barrier 132 from the outside during a practice session so as to prevent, for example, a child from entering the open air location 122 from the interior of the guest unit 120*b*.

Figure 5:
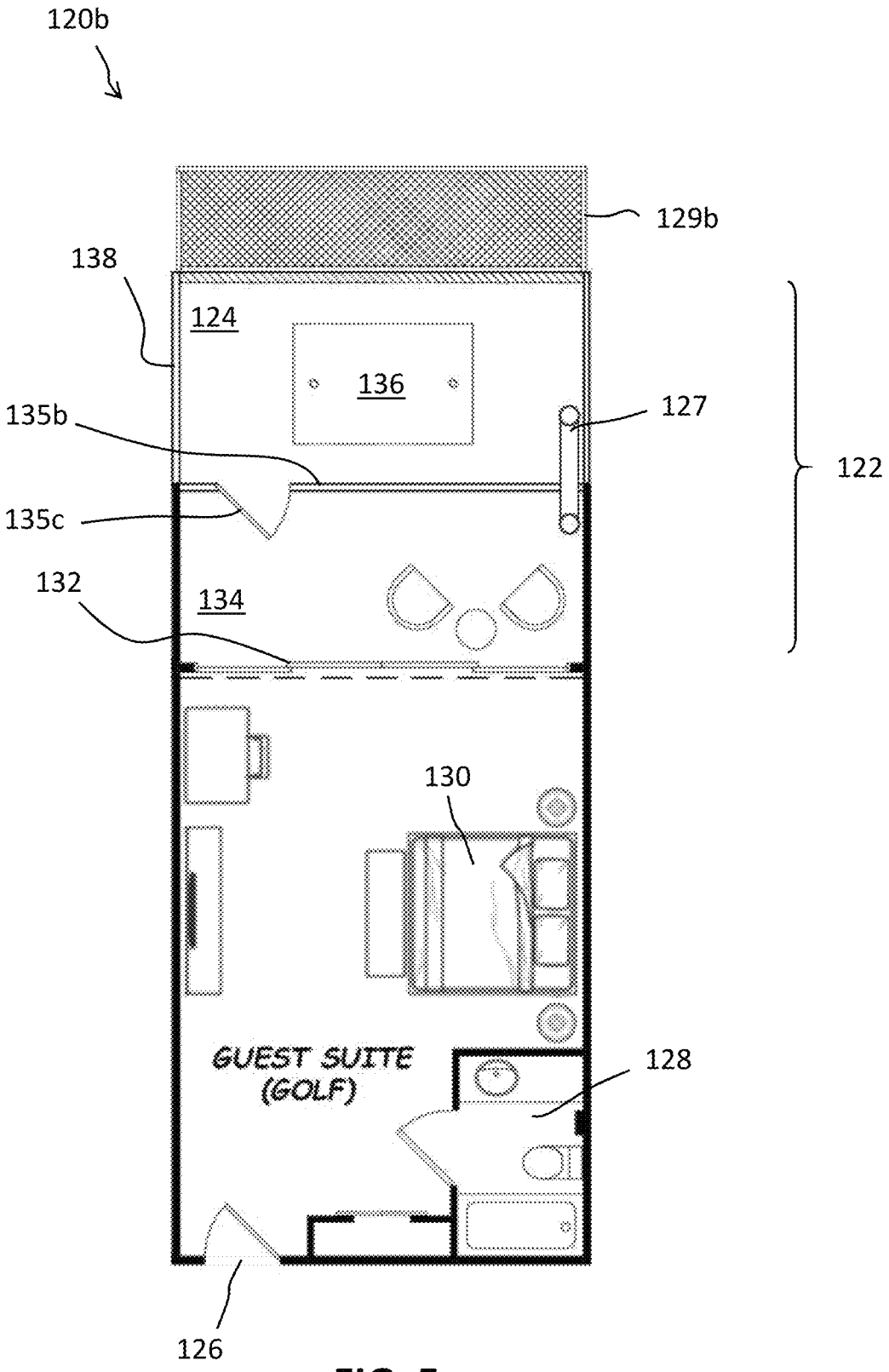
FIG. 5 depicts another example guest suite in accordance with various aspects of the present teachings.

Moreover, in some aspects of the present teachings, one or more additional protective measures may be provided to prevent accidents such as falls and/or collisions with an active golfer in the hitting area 124. For example, with specific reference to the guest units 120*a* of FIGS. 2 and 3, a warning tape or step 135*a* may separate the hitting area 124 from the sitting area 134 to indicate a safe distance from which to watch a golfer so as to help prevent collisions. Additionally or alternatively to a step and/or warning tape 135*a* of guest unit 120*a* of FIG. 3, the example guest unit 120*b* includes a protective barrier 135*b* disposed between the hitting area 124 and barrier 133, as shown in FIGS. 2 and 5. Examples of protective barriers to at least partially separate the hitting area 124 from other portions of the open air location 122 (e.g., within the sitting area 134) include partial walls or railings having a gate 135*c* that be selectively closed and/or secured. It will be appreciated that such protective barriers may be preferably included in configurations in which a safety structure such as net 129*b* on the guest unit 120*b* of FIG. 5 remains consistently open and/or flat (e.g., at or below the level of the hitting area 124) such that a user of guest unit 120*b* could hit balls to the target area 150 without risk of ricochet. In such instances, the gate 135*c* of the barrier 135*b* could be secured (e.g., via a lock, latch, or security card), for example, to prevent a guest (e.g., a small child) from entering the hitting area 124 and/or falling from the edge of the net 129.

With reference again to guest unit 120*a* of FIGS. 2-4, the protective barrier 129*a* between the hitting area 124 and the target area 150 of guest unit 120*a* is similar to the barrier 129*b* of guest unit 120*b* in that it can prevent falls to ground level from the hitting area 124. However, as shown in comparing FIGS. 3 and 4, the protective barrier 129*a* may alternatively be moved between a closed (retracted) position (FIG. 3) and an open position (FIG. 4) when a user is ready to hit balls from the hitting area 124. It will be appreciated that while the protective barrier 129*a* is substantially transparent and is depicted as being comprised of safety netting or cables to prevent falls as with safety net 129*b*, alternative materials may nonetheless be utilized to prevent a user from falling to ground level from the hitting area 124, including solid (opaque) materials, with the barrier 129*a* being able to be removed prior to a user hitting balls. Notably, in the open position depicted in FIG. 4, the protective barrier 129*b* does not present a surface from which a ball hit from the hitting area 124 would rebound toward the golfer. For example, the protective barrier 129*a* may be substantially perpendicular to the hitting area when in the closed position of FIG. 3 to prevent falls and/or entry to the target area 150 from the open air location 122 when the hitting area 124 is not in use, but may be opened flat (e.g., at or below the level of the hitting area 124) as depicted in FIG. 4 so as not to present a surface from which a ball hit could ricochet back toward the user when using the hitting area 124. It will be appreciated in light of the present teachings that the protective barrier 129*a* may be moved using a variety of mechanisms (e.g., hydraulics, wench and cables, etc.). However, in some aspects, the protective barrier 129*a* may be operated only under the control of certain guests of the guest unit (e.g., using a security card).

With reference again to FIG. 2, the depicted hitting area 124 may be associated with a ball delivery mechanism 127. Thus, not only may a user obtain range balls via room service or from the dispenser in vending/ice area 115, the present teachings also provide for the automatic delivery of golf balls directly to the hitting area 124. By way of non-limiting example, the depicted golf ball delivery mechanism 127 may comprise a series of pipes that are fed via gravity (e.g., released from a reservoir of golf balls on an upper level or roof) or pneumatically (e.g., under pressure). In some additional or alternative aspects, the ball delivery mechanism 127 can be configured such that a golf ball will not be delivered to the user until the protective barrier 129*a* has been opened, for example, in order to prevent ricochets.

As is known in the art of interactive driving ranges (e.g., TOPGOLF-branded driving ranges) and golf ball tracking technologies (e.g., TRACKMAN), shot results and golf swings can be digitally analyzed and displayed to the user. As discussed above and shown in FIGS. 3A and 4A, methods and systems in accordance with the present teachings can provide a display 137 within the open air location 122 to allow a user of the hitting area 124 to view statistics about that user's swings or shots and/or can allow a user or users to play games based on the target area. By way of example, golf ball tracking technologies could provide details regarding ball flight and/or the user's swing or club face that can be displayed on the display 127. Additionally or alternatively, "smart" balls may be provided to the users such that the final location of each shot may be determined, for example, to determine whether a shot to an intended target was successful. Accuracy and/or distance for each shot could be scored and displayed. In some aspects, for example, coordinates for one or more golf balls hit from the hitting area 124 of guest unit 120*a* can be determined and displayed to the user as a score indicative of the success of the shot. Similarly, another user of guest unit 120*a* could also hit different "smart" balls and could obtain a different score that could be compared to the first guest so as to generate a competition among current users of the guest unit 120*a*. Competitions or rankings between various guest units 120 are also possible in accordance with the present teachings. By way of example, a guest of unit 120*a* could challenge a guest of unit 120*b* over a series of shots (a la a basketball game of horse) with the score being determined based on proximity to a selected target and/or distance, with the results of each user being displayed on the display 137 of both guest units.

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. An accommodations and entertainment complex, comprising:

a hotel comprising a plurality of guest units, wherein each of the plurality of guest units is separated from a common area by at least one door that is configured to be secured by the one or more guests associated with that guest unit, wherein each respective guest unit comprises:

a bed;

a bathroom;

a balcony defining a golf ball hitting area within an open air location, wherein the hitting area is only accessible through the respective guest unit; and a barrier configured to separate the open air location from at least one room associated with the respective guest unit; and a target area comprising one or more targets configured for a golf ball hit by a user from the hitting area associated with each of the plurality of guest units.

2. The complex of claim 1, further comprising a golf mat disposed within each hitting area of the plurality of units.

3. The complex of claim 1, wherein the barrier comprises a door.

4. The complex of claim 1, wherein at least a portion of the barrier is transparent.

5. The complex of claim 1, wherein the common area comprises an interior hallway.

6. The complex of claim 1, wherein the common area comprises an exterior corridor.

7. The complex of claim 1, further comprising a golf ball delivery mechanism for delivering a plurality of golf balls to the hitting area associated with each of the plurality of units.

8. The complex of claim 1, further comprising one or more lights for lighting the target area.

9. The complex of claim 8, further comprising a retractable shade to selectively prevent light being transmitted between each open air location and the room associated with that guest unit.

10. The complex of claim 1, wherein the barrier is configured to dampen transmission of sound between the open air location and the room.

11. The complex of claim 10, wherein the barrier comprises a double-paned glass door.

12. The complex of claim 10, wherein the barrier exhibits a composite sound transmission class (STC) greater than about 50.

13. The complex of claim 1, further comprising a display associated with the open air location of each of the guest units.

14. The complex of claim 13, wherein the display is configured to display a score indicative of the proximity of one or more golf balls hit from the hitting area associated with the corresponding guest unit.

15. The complex of claim 14, wherein the display is further configured to display a score indicative of the proximity of one or more golf balls hit from the hitting area associated with other guest units.

16. The complex of claim 1, further comprising a protective barrier to each of the plurality of units between the barrier and the hitting area.

17. The complex of claim 16, wherein the protective barrier is disposed between the hitting area and the barrier.

18. The complex of claim 16, wherein the protective barrier is configured to at least partially separate the hitting area from the target area.

19. The complex of claim 18, wherein the protective barrier is retractable.

20. A method of entertainment for guests of a hotel comprising multiple guest units, the method comprising:

providing a balcony defining a golf ball hitting area to each of a plurality of the guest units of the hotel, wherein each hitting area is disposed within an open air location associated with a respective said guest unit and only accessible to a user through the respective guest unit, and wherein each guest unit is provided with at least one bed and a bathroom and is separated from a common area by at least one door that is configured to be secured by the one or more guests associated with that guest unit;

providing a target area comprising one or more targets configured for a golf ball hit from the hitting area associated with each of the plurality of guest units; and providing a barrier to each of the plurality of guest units, wherein the barrier is configured to separate the open air location associated with each of the plurality of guest units from a room in the respective guest unit.

21. The method of claim 20, further comprising providing a golf mat within each hitting area of the plurality of guest units.

22. The method of claim 20, further comprising providing a protective barrier to each of the plurality of units within the open air location.

23. The method of claim 20, further comprising:

lighting the target area; and providing a retractable shade to the barrier to selectively prevent light being transmitted between each open air location and the room associated with that guest unit.

24. The method of claim 20, further comprising delivering a plurality of golf balls to the hitting area associated with each of the plurality of units.

25. The method of claim 20, further comprising receiving coordinates for one or more first golf balls hit from a first hitting area associated with a first unit.

26. The method of claim 25, further comprising displaying on a display associated with the first unit a first score indicative of the proximity of the one or more first golf balls relative to at least one of the one or more targets.

27. The method of claim 26, further comprising receiving coordinates for one or more second golf balls hit from a second hitting area associated with a second unit; and displaying on the display associated with the first unit a second score indicative of the proximity of the one or more second golf balls relative to at least one of the one or more targets.

* * * * *